US012006122B2

(12) United States Patent
Uchiyama

(10) Patent No.: US 12,006,122 B2
(45) Date of Patent: Jun. 11, 2024

(54) SYNTHETIC RESIN BOTTLE

(71) Applicant: TOYO SEIKAN CO., LTD., Tokyo (JP)

(72) Inventor: Takeshi Uchiyama, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 124 days.

(21) Appl. No.: 16/976,288

(22) PCT Filed: Feb. 26, 2019

(86) PCT No.: PCT/JP2019/007294
§ 371 (c)(1),
(2) Date: Aug. 27, 2020

(87) PCT Pub. No.: WO2019/167936
PCT Pub. Date: Sep. 6, 2019

(65) Prior Publication Data

US 2021/0039865 A1 Feb. 11, 2021

(30) Foreign Application Priority Data

Feb. 28, 2018 (JP) ..... 2018-034994

(51) Int. Cl.
*B65D 79/00* (2006.01)
*B65D 1/02* (2006.01)

(52) U.S. Cl.
CPC ..... *B65D 79/0084* (2020.05); *B65D 1/0207* (2013.01); *B65D 1/0223* (2013.01); *B65D 2501/0027* (2013.01)

(58) Field of Classification Search
CPC ..... B65D 79/0084; B65D 1/0207; B65D 1/0223; B65D 2501/0027
(Continued)

(56) References Cited

U.S. PATENT DOCUMENTS 6,112,925 A 9/2000 Nahill et al.
7,347,339 B2 * 3/2008 Bangi ..... B65D 1/0223 220/666
(Continued)

FOREIGN PATENT DOCUMENTS

CA 2515642 A1 9/2004
CA 2528836 A1 11/2004
(Continued)

OTHER PUBLICATIONS

International Search Report dated May 28, 2019 in PCT/JP2019/007294 with English-language translation (5 pgs.).
(Continued)

*Primary Examiner* — Robert J Hicks
*Assistant Examiner* — Sanjidul Islam
(74) *Attorney, Agent, or Firm* — Foley & Lardner LLP

(57) ABSTRACT

A synthetic resin bottle, which has a pressure reduction absorbing performance and which exhibits a cylindrical shape in which the appearance of the body section to which the label is attached is similar to a perfect circle, is provided. A synthetic resin bottle 1 having cylindrical body section 3 has four pressure reduction absorbing panels 8 arranged at equal intervals in body section 3, and column portions 9 each having an arc-shaped wall surface 9*a* arranged between pressure reduction absorbing panels 8. Arc-shaped wall surface 9*a* of column portion 9 in a cross section of body section 3 constitutes a part of a virtual single true circle 10. Total circumferential length of arc-shaped wall surfaces 9*a* of column portions 9 is 55% to 75% of entire circumferential length of true circle 10.

11 Claims, 9 Drawing Sheets

(58) Field of Classification Search
USPC ..... 215/381
See application file for complete search history.

(56) References Cited

U.S. PATENT DOCUMENTS

| | | | | |
|---|---|---|---|---|
| 8,083,081 | B2 * | 12/2011 | Coley, Jr. ..... | B65D 1/023 215/381 |
| 2004/0159627 | A1 | 8/2004 | Trude | |
| 2004/0159628 | A1 | 8/2004 | Trude | |
| 2008/0314862 | A1 | 12/2008 | Matsuoka et al. | |
| 2017/0334628 | A1 * | 11/2017 | Bangi ..... | B65D 1/46 |

FOREIGN PATENT DOCUMENTS

| | | | |
|---|---|---|---|
| EP | 1 179 482 | A1 | 2/2002 |
| JP | H10-139027 | A | 5/1998 |
| JP | 2001-206331 | A | 7/2001 |
| JP | 2003-011942 | A | 1/2003 |
| JP | 2003-261197 | A | 9/2003 |
| JP | 2006-321522 | A | 11/2006 |
| JP | 2012-180122 | A | 9/2012 |
| JP | 2015-131664 | A | 7/2015 |
| JP | 1566814 | S | 1/2017 |
| JP | 1567373 | S | 1/2017 |
| JP | 2018-039522 | A | 3/2018 |
| WO | WO-98/36891 | A1 | 8/1998 |
| WO | WO-2004/074116 | A2 | 9/2004 |
| WO | WO-2004/094261 | A1 | 11/2004 |
| WO | WO-2018/037287 | A2 | 3/2018 |

OTHER PUBLICATIONS

Notice of Reasons for Refusal on JP Appl. Ser. No. 2018-034994 dated Mar. 28, 2022 (15 pages).
Notice of Reasons for Refusal on JP Appl. Ser. No. 2018-034994 dated Sep. 13, 2022 (11 pages).

* cited by examiner

SYNTHETIC RESIN BOTTLE

CROSS REFERENCE TO RELATED APPLICATIONS

This application is a national stage entry of International Appl. No. PCT/JP2019/007294, filed Feb. 26, 2019; which claims priority to Japanese Appl. No. 2018-034994, filed Feb. 28, 2018; the contents of which are incorporated by reference herein in their entirety.

TECHNICAL FIELD

The present invention relates to a synthetic resin bottle, and more particularly, to a synthetic resin bottle having a pressure reduction absorbing panel in a body section and having a cylindrical shape in which the appearance of the body section to which a label is attached is similar to a perfect circle.

BACKGROUND ART

Bottles for beverages, which are made of synthetic resin such as PET (polyethylene terephthalate), have various advantages such as being inexpensive and lightweight. In the non-carbonated beverage, hot filling or aseptic filling is performed. In hot filling, the beverage is heat sterilized to a high temperature and filled into a heat-resistant bottle in a high temperature state and sealed. In aseptic filling, a beverage is sterilized at a high temperature and for short time, and the bottle is sterilized by medicine or the like, and a beverage is filled into the bottle at ordinary temperature (about 30° C.) under aseptic conditions and sealed. In a bottle (aseptic bottle) in which the aseptic filling described above is performed, a decrease in internal pressure (pressure reduction) due to a change in volume over time occurs in an unopened state. This may cause the body section of the bottle to become non-uniformly deformed. If the bottle body section is deformed and distorted, the appearance becomes poor, and the product value drops remarkably. Therefore, a pressure reduction absorbing panel is provided in the body section.

In the synthetic resin bottle described in Patent Document 1, the bottom plate is provided with a pressure reduction absorbing portion composed of a bowl-shaped concave portion in which a spiral concave groove is formed. The body section is provided with a reinforcing portion consisting of a plurality of circumferential grooves which are formed in parallel in the height direction.

The plastic bottle described in Patent Document 2 has a bode section having an octagonal cross-section. The plastic bottle is an octahedral bottle having an arc-shaped wall surface formed at each corner, in which the pressure reduction absorbing surface made of an inclined wall and a flat wall is disposed between arc-shaped wall surfaces, and the plastic bottle can be heated and filled. This bottle is a plastic bottle which has a pressure reduction absorbing surface that has a column angle within the range from 60° to 115° formed between inclined walls connected to both sides of an arc-shaped wall surface.

PRIOR ART DOCUMENTS

Patent Documents

Patent Document 1: JP2015-131664A
Patent Document 2: JP2001-206331A

SUMMARY OF THE INVENTION

Problems to be Solved by the Invention

In a synthetic resin bottle disclosed in Patent Document 1 in which a pressure reduction absorbing portion is provided on a bottom plate and a reinforcing portion made of a plurality of circumferential grooves (beads) arranged in parallel in a height direction is provided in a body section, or in a plastic bottle disclosed in Patent Document 2 in which a pressure reduction absorbing surface (pressure reduction absorbing panel) is arranged on a bottle body section, when a label, in particular, a shrink label made of a heat shrink film is attached to the body section, the bead or pressure reduction absorbing panel exhibits an appearance peculiar to the synthetic resin bottle. A synthetic resin bottle that has such an appearance may not have a preferable appearance as a container depending on the type of beverage to be filled and sealed. For example, it is sometimes preferable that the outer appearance of the body section of the synthetic resin bottle be a perfect circular cylinder like a glass or metal bottle. However, in the case of a synthetic resin bottle, it has been difficult to achieve both the above-mentioned pressure reduction absorbing performance and the appearance of the body section to which the label is attached that exhibits a perfect circular cylindrical shape.

It is therefore an object of the present invention to provide a synthetic resin bottle which has a pressure reduction absorbing performance for absorbing the reduction of internal pressure, prevents the body section from being deformed and distorted, even in a pressure reduction state, and exhibits a cylindrical shape in which the appearance of the body section to which the label is attached is similar to a perfect circle.

Means to Solve the Problems

A synthetic resin bottle having a cylindrical body section of the present invention is characterized in that the synthetic resin bottle has four pressure reduction absorbing panels arranged at equal intervals in the body section, and column portions each having an arc-shaped wall surface arranged between the pressure reduction absorbing panels; the arc-shaped wall surface of the column portion in a cross section of the body section constitutes a part of a virtual single true circle; and total circumferential length of the arc-shaped wall surfaces of the column portions is 55% to 75% of entire circumferential length of the true circle.

Further, a synthetic resin bottle having a cylindrical body section of the present invention is characterized in that the synthetic resin bottle has four pressure reduction absorbing panels arranged at equal intervals in the body section, and column portions each having an arc-shaped wall surface arranged between the pressure reduction absorbing panels; the arc-shaped wall surface of the column portion in a cross section of the body section constitutes a part of a virtual single true circle; and an angle formed between a radial line passing through a circumferential center of the column portion and a radial line passing through a circumferential edge of the column portion is 55% to 75% of an angle formed between a radial line passing through a circumferential center of the column portion and a radial line passing through a circumferential center of a pressure reduction absorbing panel adjacent to the column portion.

In the synthetic resin bottle of the present invention, with respect to the number of pressure reduction absorbing panels constituting the body section and the ratio of the region occupied by the column portion of the body section in the cross section, a condition is defined for achieving both absorption of the reduction of the internal pressure and the appearance in which the body section, to which the label is attached, exhibits a cylindrical shape similar to a true circle.

Effect of the Invention

According to the present invention, it is possible to provide a synthetic resin bottle which has a pressure reduction absorbing performance for absorbing the reduction of internal pressure, prevents the body section from being deformed and distorted, even in a pressure reduction state, and exhibits a cylindrical shape in which the appearance of the body section to which the label is attached is similar to a perfect circle.

EMBODIMENTS OF THE INVENTION

Embodiments of the present invention will be described below with reference to the drawings.

[Basic Structure of Synthetic Resin Bottle]

Figure 1:
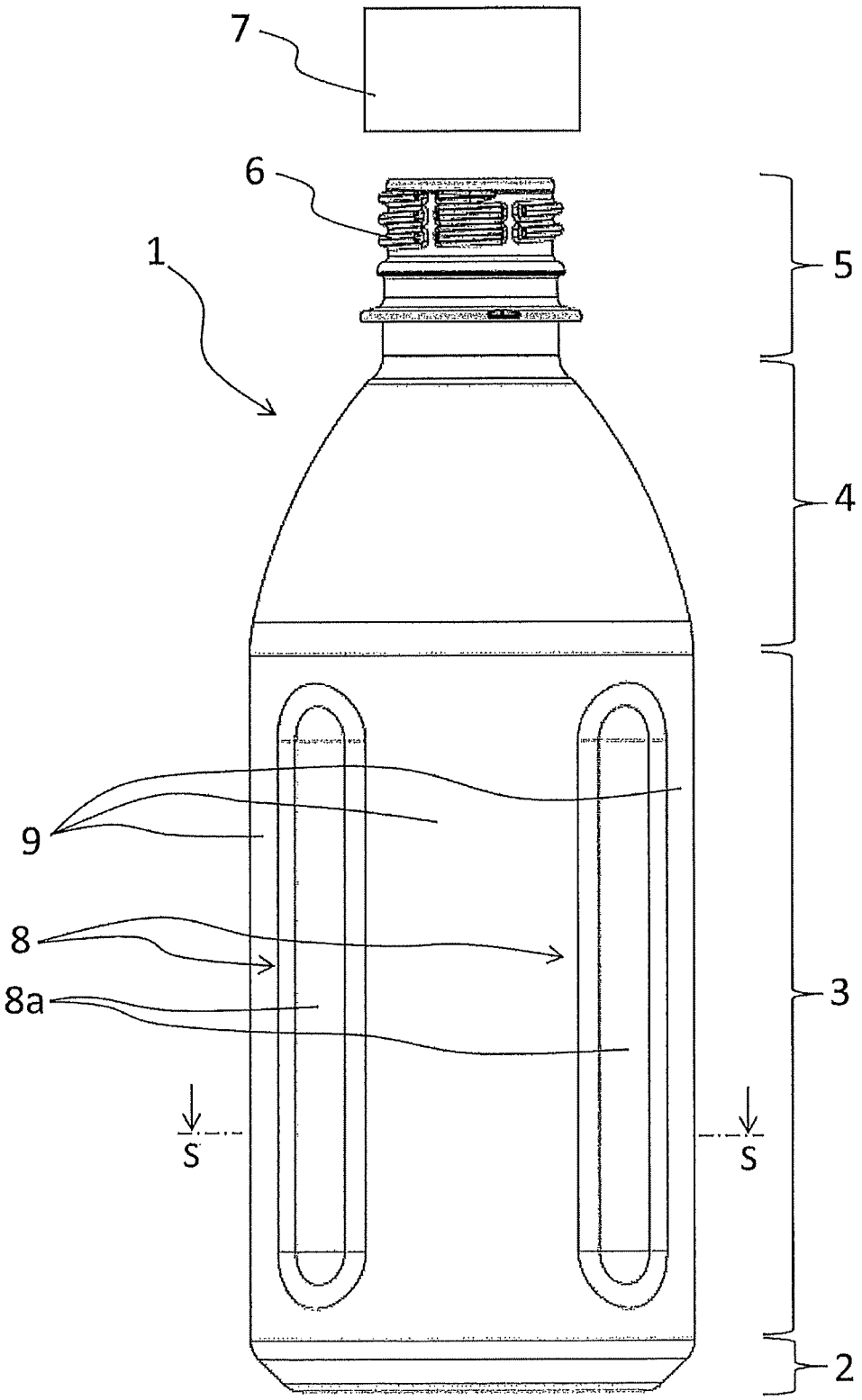
FIG. 1 Front view of the synthetic resin bottle of the first embodiment of the present invention FIG. 2 Cross-sectional view schematically showing the outer shape of the cross section which is cut at the position of S-S line in FIG. 1, by a contour line FIG. 3 Enlarged view of a part of FIG. 2
Figure 2:
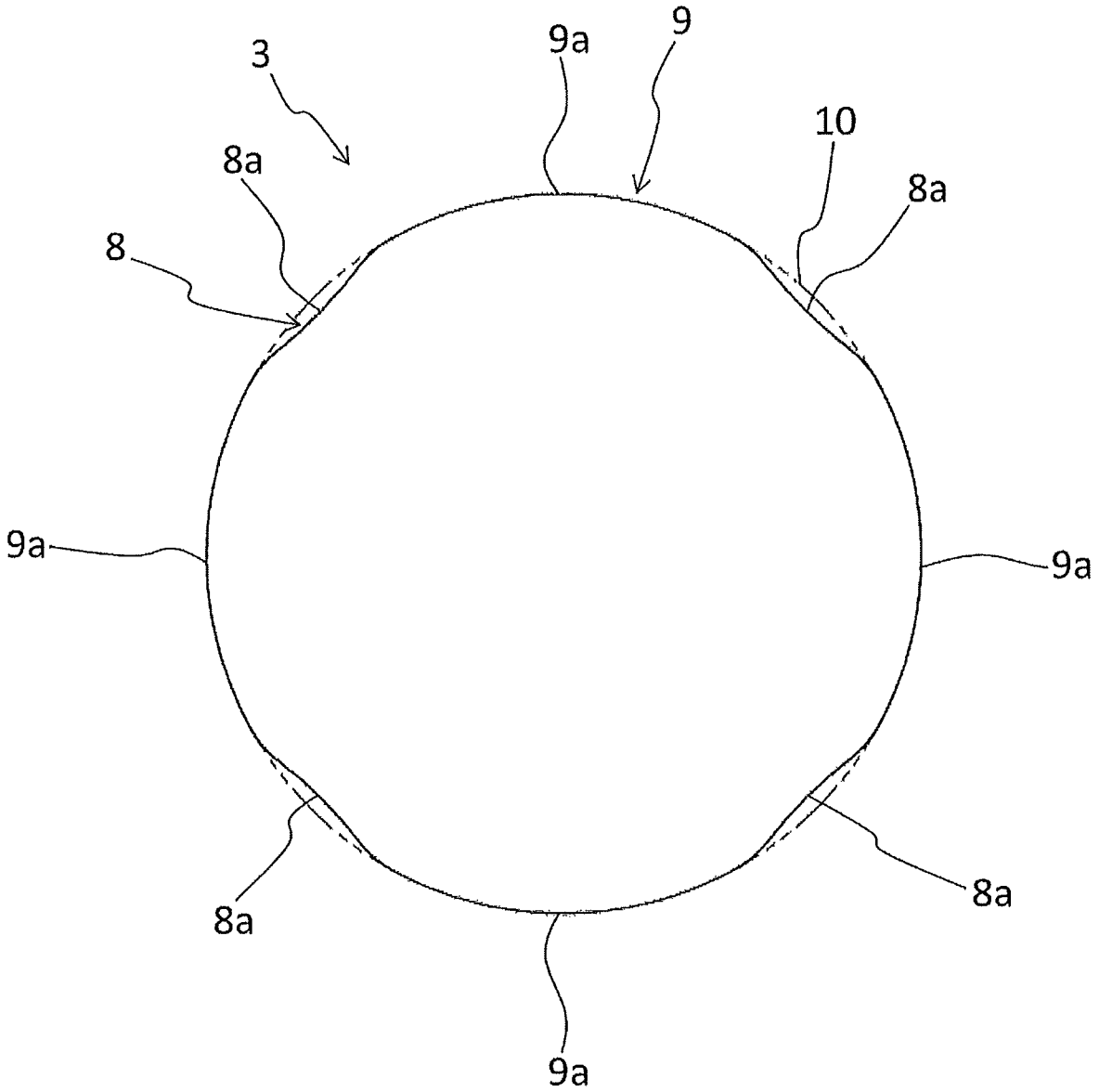
Figure 3:
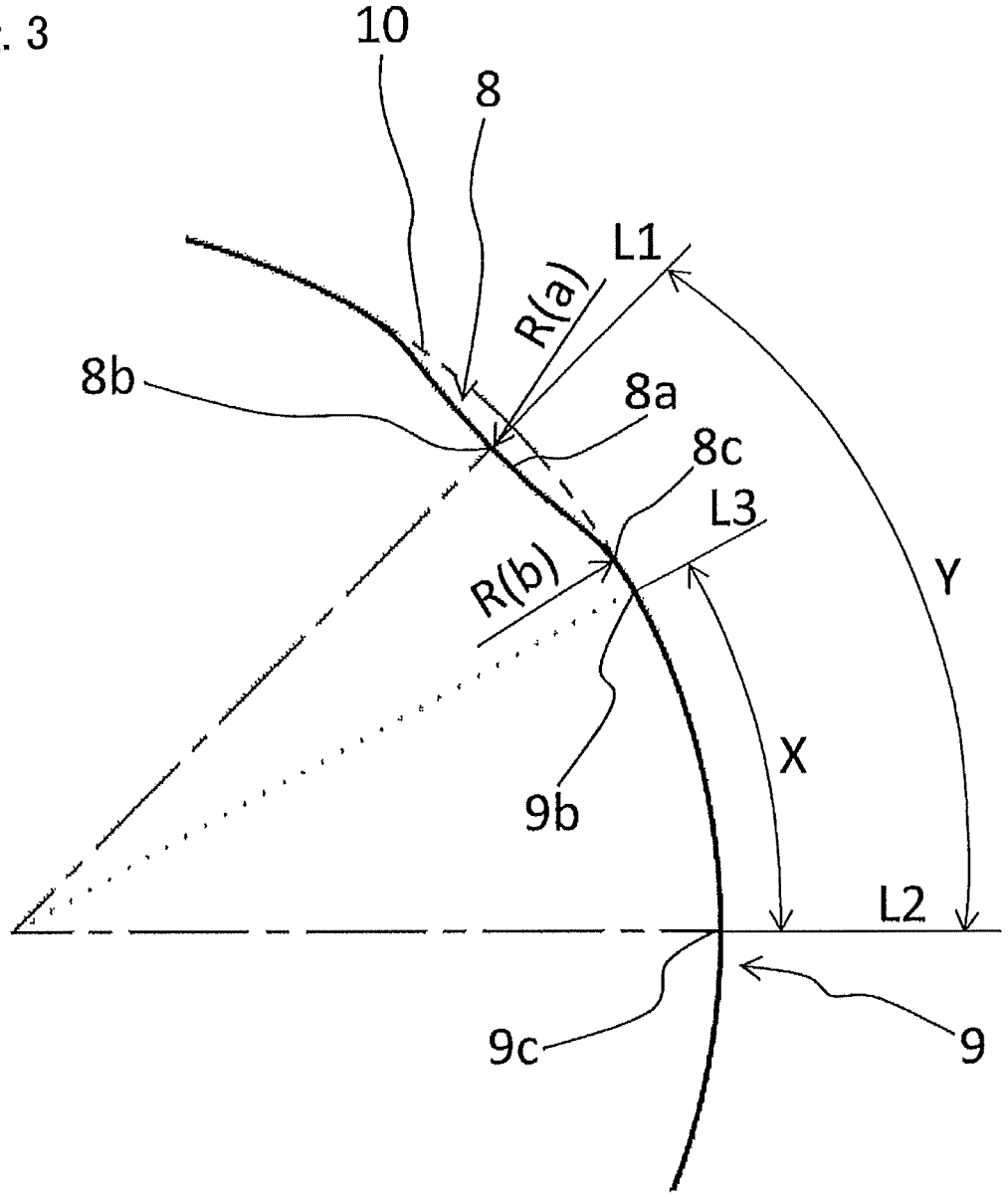

FIG. 1 shows a front view of the synthetic resin bottle 1 of the first embodiment of the present invention. FIG. 2 schematically shows the cross sectional shape which is cut at the position of S-S line in FIG. 1. FIG. 3 is an enlarged view of a part of FIG. 2. This synthetic resin bottle 1 is made of a synthetic resin such as polyethylene terephthalate (PET) and stores a non-carbonated beverage such as coffee or tea, and is particularly suitable for the aforementioned aseptic filling. As shown in FIG. 1, synthetic resin bottle 1 is provided with heel section 2, cylindrical body section 3, a tapered (substantially conical) shoulder section 4 tapering toward the upper portion, neck section 5 having a small diameter, from the lower portion toward the upper portion. Synthetic resin bottle 1 can stand alone in a state in which heel section 2 is placed on a flat surface, for example, a top surface of a desk or a table, or a floor surface. The end of neck section 5 is an opening which serves as a drinking spout. External thread portion 6 is provided on the outer periphery of the opening. External thread portion 6 is screwed into screw cap 7 with internal thread portion (not shown) to seal the opening.

[Structure of the Body Section]

As shown in FIGS. 1 and 2, four pressure reduction absorbing panels 8 are arranged in an equidistant manner on body section 3 of synthetic resin bottle 1. The upper portion and the lower portion of pressure reduction absorbing panels 8 each has a circular arc shape. Column portion 9 is provided between pressure reduction absorbing panels 8. Pressure reduction absorbing panel 8 has concave 8*a*. As shown in FIGS. 2 and 3, column portion 9 is made of arc-shaped wall surface 9*a*. Arc-shaped wall surfaces 9*a*, of all column portions 9, constitute part of virtual one true circle 10 in the cross section of the body section 3, respectively. On the other hand, the wall surface of pressure reduction absorbing panel 8 is concave, and does not overlap with virtual true circle 10 which is virtually formed by connecting arc-shaped wall surfaces 9*a* of all column sections 9. The wall surface of pressure reduction absorbing panel 8 may be flat. In the present invention, in the transverse section of body section 3 (e.g., cross section which is cut at the position of S-S line), the sum of the circumferential lengths of arc-shaped wall surfaces 9*a* of column portions 9 (referred to as total circumferential length A of all column portions) is 55% to 75% of the entire circumferential length of virtual true circle 10 which is virtually formed by connecting arc-shaped wall surfaces 9*a* of all column portions 9 (referred to as entire circumferential length B of the true circle). In the illustrated embodiment, total circumference A of all column portions is 63% of entire circumference length B of the true circle.

In the case where the circumferential lengths of all pressure reduction absorbing panels 8 are equal and where all column portions 9 have the same shape and the circumferential lengths thereof are equal, in the body section 3 of synthetic resin bottle 1, ratio A/B of above-mentioned total circumferential length A of all column portions to above-mentioned entire circumferential length B of true circle can be obtained as follows. As shown in FIG. 3, in the cross section, ratio X/Y of angle X with respect to angle Y corresponds to abovementioned ratio A/B of the length A with respect to length B. Angle Y is formed between radial line L1 passing through circumferential center 8*b* of pressure reduction absorbing panel 8 and radial line L2 passing through circumferential center 9*c* of column portion 9 adjacent thereto. Angle X is formed between radial line L2 and radial line L3 passing through edge 9*b* in the circumferential direction of column portion 9 (pressure reduction absorbing panel 8). Edge 9*b* in the circumferential direction of column portion 9 is a point where the curvature of the arc-shaped wall surface 9*a* changes and a point of the boundary between the portion that overlaps with virtual true circle 10 and the portion that does not overlap with virtual true circle 10. Angle X is 28.5 degrees and angle Y is 45 degrees, and therefore, angle ratio X/Y is 28.5/45=63% in the present embodiment.

In the present invention, the technical significance of setting total circumferential length A of all column portions within the range from 55% to 75% of entire circumferential length B of the true circle will be described.

In a conventional general synthetic resin bottle, total circumferential length A of all column portions in the cross section of body section 3 is 10% or less of entire circumferential length B of the true circle. In other words, the ratio of a region which is occupied by pressure reduction absorbing panel 8 is about 90% or more. It is possible to sufficiently absorb the pressure reduction and to reduce the amount the deformation of the synthetic resin bottle to a small level. However, in most of body section 3, the wall surface is composed of pressure reduction absorbing panel 8 which is not arc-shaped. Therefore, its cross-sectional shape is a substantially a polygonal shape. Appearance of body section 3 to which the shrink label is attached, exhibits a substantially polygonal tubular shape.

On the other hand, in synthetic resin bottle 1 of the present invention, with respect to the structure of the body section described above, design conditions are derived in which the appearance of body section 3 to which the shrink label is attached (see FIG. 6) exhibits a cylindrical shape similar to a perfect circle while maintaining the pressure reduction absorbing performance. Pressure reduction over time in the unopened state of synthetic resin bottle 1 which is filled with the beverage by the aseptic filling is mainly due to the following reasons. The volume of oxygen decreases because oxygen in the headspace of neck section 5 dissolves in the beverage. The volume of the beverage decreases because the moisture of the beverage contained in synthetic resin bottle 1 slightly permeates from body section 3 to the outside. On the other hand, pressure reduction in the synthetic resin bottle which is filled with the beverage by hot filling is caused not only by volume reduction similar to the above-mentioned aseptic filling case, but also by volume reduction in which the temperature of the beverage which was filled and sealed at high temperature and the temperature of the gas in the head space decrease to a normal temperature. Therefore, the necessary amount of pressure reduction absorption in synthetic resin bottle (aseptic bottle) 1 for aseptic filling is smaller than that in the synthetic resin bottle (heat resistant bottle) for hot filling. For example, in an aseptic bottle having an internal capacity of about 400 ml (height: 162 mm, diameter of the body section: 66 mm, length of the body section: 103 mm, and diameter of opening: 38 mm), the required amount of pressure reduction absorption is about 7 ml in about 1 year. Taking into account such a difference in volume reduction, it has been found that the space occupied by pressure reduction absorbing panel 8 must be 25% or more of the entire wall surface of body section 3 to ensure that the pressure reduction absorbing panel is of a size sufficient enough to prevent excessive irregular deformation even if the pressure reduction is absorbed. Therefore, in the present invention, total circumferential length A of column portion 9 in the cross section of body section 3 is set to 75% or less of entire circumferential length B of the true circle to maintain the size of pressure reduction absorbing panel 8. Thereby, it is possible to absorb the pressure reduction. In order to obtain sufficient pressure reduction absorbing performance, it is preferable that the length of pressure reduction absorbing panel 8 in the vertical direction be 70% or more of the entire length of body section 3 in the vertical direction to ensure that the size of the pressure reduction absorbing panel is sufficient.

On the other hand, in body section 3, if the ratio of the space occupied by a pressure reduction absorbing panel 8 whose concave or flat wall surface is too large, the cross-sectional shape of body section 3 becomes a substantially polygonal shape. Therefore, in the present invention, total circumferential length A of all column portions in the cross section of body section 3 is set to 55% or more of entire circumferential length B of the true circle, and the number of pressure reduction absorbing panels is set to four. Thus, the appearance of the body section 3 to which the shrink label is attached, can be a cylindrical shape similar to a true circle. On the other hand, when the number of pressure reduction absorbing panels is small and when each pressure reduction absorbing panel 8 is large, the concave or flat wall surface is large. Therefore, it is difficult to obtain body section 3, to which a shrink label is attached, whose appearance will exhibit a cylindrical shape similar to a perfect circle. On the other hand, when the number of the pressure reduction absorbing panels 8 is large, each pressure reduction absorbing panel 8 is small and pressure reduction absorbing performance is significantly decreased, so that the required pressure reduction absorbing performance cannot be obtained. Therefore, taking into consideration these situations, the present invention provides synthetic resin bottle 1 in which the number of pressure reduction absorbing panels is defined (four), and in which the ratio of total circumferential length A of all column portions in the cross section of body section 3 with respect to entire circumferential length B of a true circle is defined (55% or more, that is, 5 times the conventional bottle or more), as a synthetic resin bottle capable of satisfying both the pressure reduction absorbing performance and the requirement to have an appearance similar to a perfect circle while not increasing the width in the circumferential direction of each pressure reduction absorbing panel 8 and not increasing the number of pressure reduction absorbing panels 8.

As described above, the significance of synthetic resin bottle 1 of the present invention, in which the number of the pressure reduction absorbing panels 8 having a relatively small width in the circumferential direction is four, will be described below. In general, it is thought that it may be necessary to increase the number of the pressure reduction absorbing panels 8 when the size of each pressure reduction absorbing panel 8 is small. However, if the number of pressure reduction absorbing panels 8 is increased, the ratio of space occupied by column portion 9 having arc-shaped wall surface 9*a* will be decreased, and it will be impossible to exhibit an appearance similar to a true circle. The Applicant has noticed that, in order to exhibit an appearance similar to a perfect circle even if a certain degree of pressure reduction absorption is performed, it is important that the recessed portion of the outer periphery of the body section due to pressure reduction absorption be uniformly generated and that a locally large recessed portion not be generated.

Figure 4A:
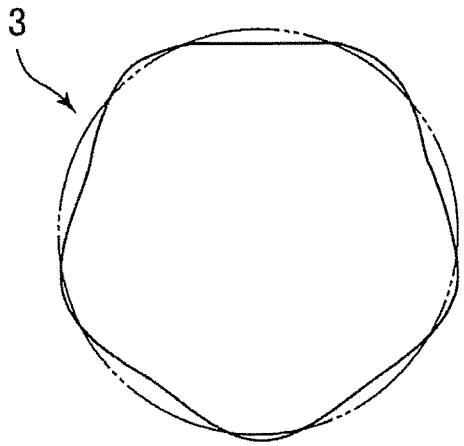
FIG. 4A Cross-sectional view schematically showing the outer shape of the synthetic resin bottle of example of the present invention and comparative examples 1 and 2 in the pressure reduction absorbing state, by a contour line FIG. 4B Cross-sectional view schematically showing the outer shape of the synthetic resin bottle of example of the present invention and comparative examples 1 and 2 in the pressure reduction absorbing state, by a contour line FIG. 4C Cross-sectional view schematically showing the outer shape of the synthetic resin bottle of example of the present invention and comparative examples 1 and 2 in the pressure reduction absorbing state, by a contour line FIG. 4D Cross-sectional view schematically showing the outer shape of the synthetic resin bottle of example of the present invention and comparative examples 1 and 2 in the pressure reduction absorbing state, by a contour line FIG. 4E Cross-sectional view schematically showing the outer shape of the synthetic resin bottle of example of the present invention and comparative examples 1 and 2 in the pressure reduction absorbing state, by a contour line FIG. 4F Cross-sectional view schematically showing the outer shape of the synthetic resin bottle of example of the present invention and comparative examples 1 and 2 in the pressure reduction absorbing state, by a contour line FIG. 5 Enlarged view of a FIG. 4C FIG. 6 Front view showing a state in which a shrink label is attached to the synthetic resin bottle of FIG. 1
Figure 4B:
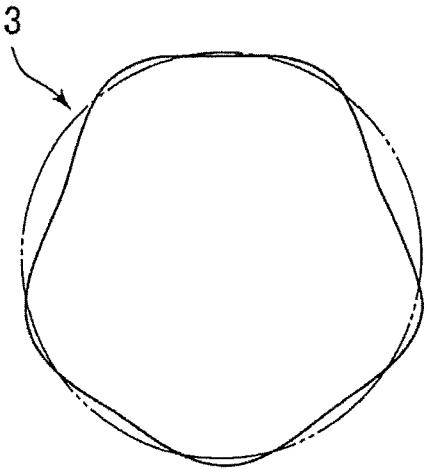
Figure 4C:
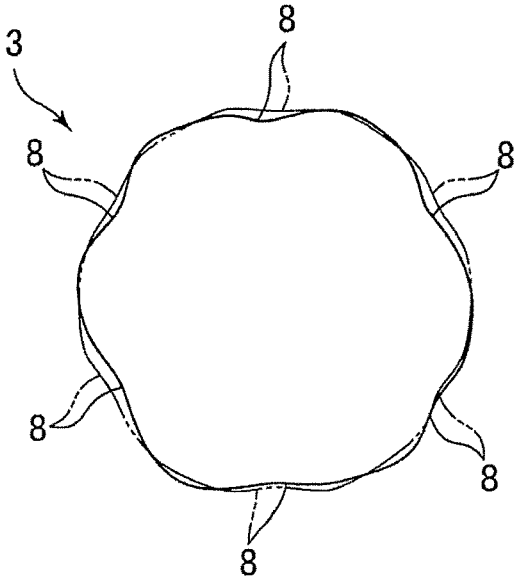
Figure 4D:
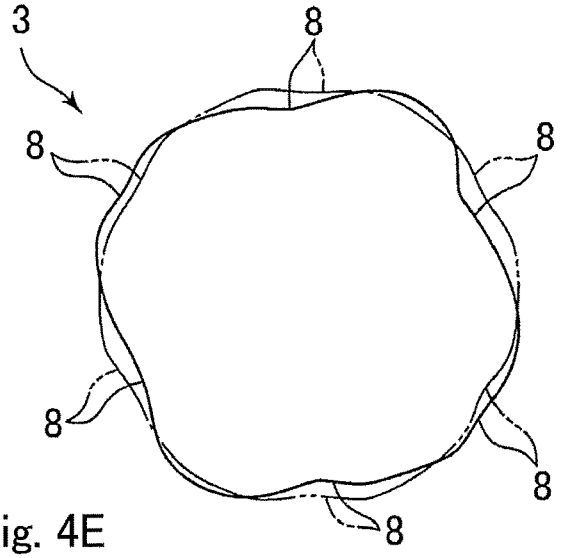
Figure 4E:
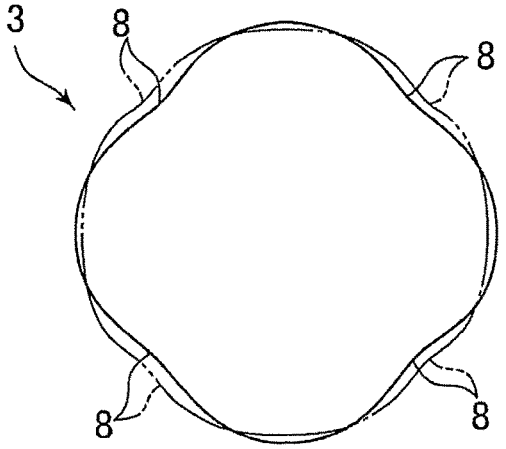
Figure 4F:
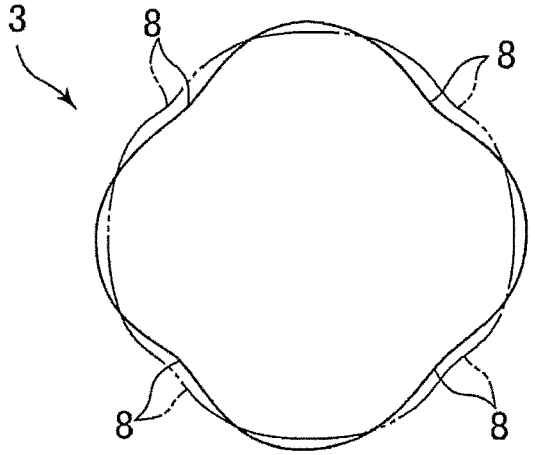

Therefore, a pressure reduction absorption state was examined for a synthetic resin bottle having four pressure reduction absorbing panels 8 according to the present invention (Example), a synthetic resin bottle having no pressure reduction absorbing panel 8 (Comparative Example 1), and a synthetic resin bottle having six pressure reduction absorbing panels 8 similar to pressure reduction absorbing panel 8 of the present invention (Comparative Example 2). More specifically, the outline of the cross section of body section 3 in the initial state of the synthetic resin bottle of Comparative Example 1 is shown (by the two-dot chain line) and the outline of the cross section of body section 3 in the pressure reduction absorbing state of Comparative Example 1 in which the volume is reduced by 7 ml is shown in FIG. 4A. The outline of the cross section of body section 3 in the initial state of the synthetic resin bottle of Comparative Example 1 is shown (by the two-dot chain line) and the outline of the cross section of body section 3 in the pressure reduction absorbing state of Comparative Example 1 in which the volume is reduced by 10 ml is shown in FIG. 4B. The outline of the cross section of body section 3 in the initial state of synthetic resin bottle of Comparative Example 2 is shown (by the two-dot chain line) and the outline of the cross section of body section 3 in the pressure reduction absorption state of Comparative Example 2 in which the volume is reduced by 7 ml is shown in FIG. 4C. The outline of the cross section of body section 3 in the initial state of synthetic resin bottle of Comparative Example 2 is shown (by the two-dot chain line) and the outline of the cross section of body section 3 in the pressure reduction absorption state of Comparative Example 2 in which the volume is reduced by 10 ml is shown in FIG. 4D. Similarly, the outline of the cross-section of body section 3 in the initial state of the embodiment is shown (by the two-dot chain line) and the outline of the cross section of body section 3 in the pressure reduction absorbing state of the embodiment in which the volume is reduced by 7 ml is shown in FIG. 4E. The outline of the cross-section of body section 3 in the initial state of the embodiment is shown (by the two-dot chain line) and the outline of the cross section of body section 3 in the pressure reduction absorbing state of the embodiment in which the volume is reduced by 10 ml is shown in FIG. 4F. In addition, Table 1 shows an upper limit value of the pressure reduction absorption amount of Embodiment and Comparative Examples 1 and 2. This exhibits the maximum amount of pressure reduction absorption that makes the appearance of body section 3 visually recognizable without causing non-uniform deformation. If the actual measured value of the pressure reduction absorption exceeds the value described in Table 1, the synthetic resin bottle will be non-uniformly deformed and will not appear to be a perfect circle even if the shrink label is attached.

TABLE 1

| | Embodiment | Comparative Example 1 | Comparative Example 2 |
|---|---|---|---|
| Number of pressure reduction absorbing panels | 4 | 0 | 6 |
| Maximum amount of pressure reduction absorption [ml] | 10 | 3 | 5 |

As shown in FIG. 4A, in the pressure reduction absorbing state in which the volume is reduced by 7 ml in Comparative Example 1, the outline of the cross section of body section 3 of the synthetic resin bottle has a substantially pentagonal shape. As shown in FIG. 4B, in the pressure reduction absorbing state in which the volume is reduced by 10 ml, a large recessed portion is generated at the upper right side and at the upper left side of the substantially pentagonal shape in FIG. 4B. However, the recessed portion is small at the lower right side and at the lower left side in FIG. 4B. The recessed portion is barely generated at the upper side. In other words, in the pressure reduction absorbing state in which the volume is reduced by 10 ml, the recessed portion in body section 3 of the synthetic resin bottle of Comparative Example 1 is not constant but disproportionate, so that the outer shape is non-uniform. Therefore, synthetic resin bottle 1 having the shrink label attached to body section 3 cannot exhibit an outer appearance similar to a perfect circle. As shown in Table 1, the maximum amount of pressure reduction absorption of the synthetic resin bottle of Comparative Example 1 was 3 ml.

Figure 5:
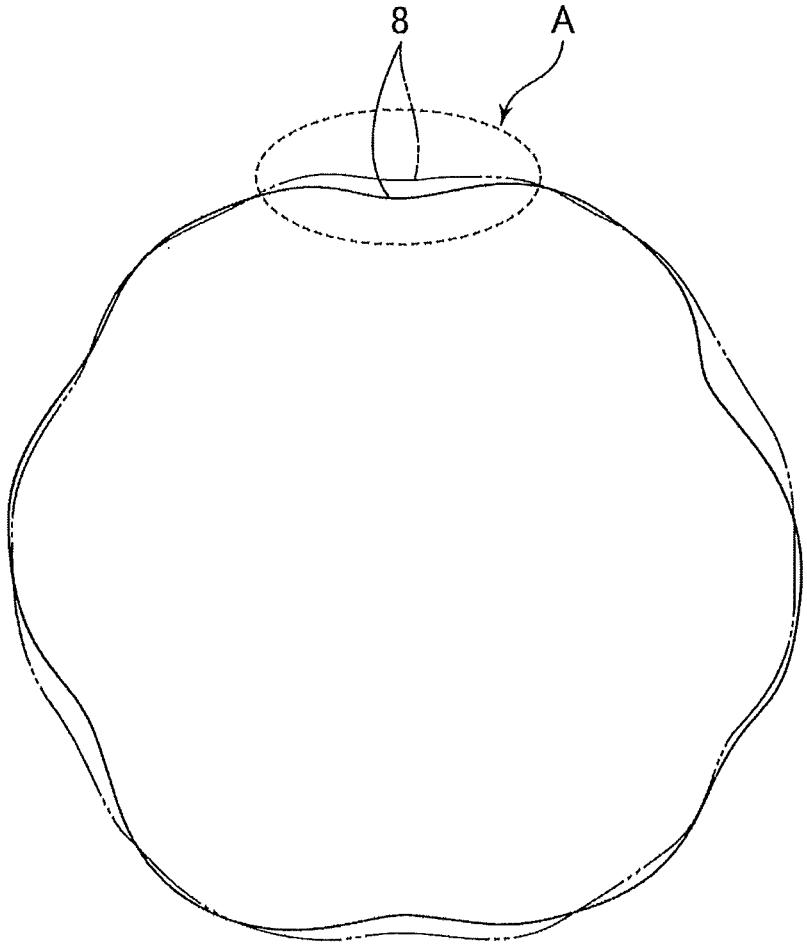

As shown in FIG. 4C, in the pressure reduction absorbing state in which the volume is reduced by 7 ml in Comparative Example 2, the outline of the cross-section of body section 3 of the synthetic-resin bottle has a substantially hexagonal shape in which each pressure reduction absorbing panel 8 constitutes the main portion of each side of the substantially hexagonal shape. The recessed portion of body section 3 is not uniform. The recessed portion, compared with the initial state, is formed at the upper side, the lower side, the upper right side and the lower left side of the substantially hexagonal shape in FIG. 4C. However, recessed portion is barely formed at the lower right side and the upper left side, similar to the initial state. As remarkably shown at A portion in FIG. 5 which is an enlarged view of FIG. 4C, non-uniform deformation is generated in body section 3 of the synthetic resin bottle of Comparative Example 2. As shown in FIG. 4D, in the pressure reduction absorbing state in which the volume is reduced by 10 ml, the outer shape of body section 3 of the synthetic resin bottle of Comparative Example 2 is further deformed non-uniformly, and synthetic resin bottle 1 having a shrink label attached to body section 3 cannot exhibit an appearance similar to a true circle. As shown in Table 1, the maximum amount of pressure reduction absorption of the synthetic resin bottle of Comparative Example 2 was 5 ml.

On the other hand, as shown in FIG. 4E, in synthetic resin bottle of the present embodiment, the outline of body section 3 in the cross section has a substantially quadrangle shape, in which pressure reduction absorbing panels 8 constitutes the main portion of each side of the substantially quadrangle shape, in the pressure reduction absorbing state in which the volume is reduced by 7 ml. In the outline of body section 3 in the cross section of the synthetic resin bottle, a substantially uniform recessed portion is formed on each side of the substantially quadrangle shape. As shown in FIG. 4F, even in the pressure reduction absorbing state in which the volume is reduced by 10 ml, substantially the same as in the pressure reduction absorbing state in which the volume is reduced by 7 ml, the outline of body section 3 in the cross section of the synthetic resin bottle has a substantially quadrangle shape, and a substantially uniform recessed portion is formed on each side of the substantially quadrangle shape. As described above, in the synthetic resin bottle of the present embodiment, a recessed portion is slightly larger in the pressure reduction absorbing state in which the volume is reduced by 10 ml than in the pressure reduction absorbing state in which the volume is reduced by 7 ml, but a relatively uniform recessed portion is formed in the four sides of the substantially quadrangle shape both in the pressure reduction absorbing state in which the volume is reduced by 7 ml and in the pressure reduction absorption state in which the volume is reduced by 10 ml. No locally significant large recessed portion is formed. The entire outline is not deformed non-uniformly. Therefore, synthetic resin bottle 1 having a shrink label attached to body section 3 of the present embodiment exhibits an appearance similar to a perfect circle. As shown in Table 1, the maximum amount of pressure reduction absorption of synthetic resin bottle 1 of the present embodiment was 10 ml.

The pressure reduction absorption state of Comparative Example 2 will be discussed again. As shown in FIG. 4C, when the amount of pressure reduction absorption is low (the volume is reduced by 7 ml), the outline of body section 3 in the cross section of synthetic resin bottle has a substantially polygonal shape (substantially hexagonal shape) corresponding to the number of pressure reduction absorbing panels 8. However, as shown in FIG. 4D, when the amount of pressure reduction absorption is high (the volume is reduced by 10 ml) the outline of body section 3 in the cross section of synthetic resin bottle has a shape closer to a quadrangle rather than a hexagon. From this aspect, it is thought that when the outer shape is a quadrangle, the structure becomes more stable than other polygons. In the process of deformation associated with the pressure reduction absorption, body section 3 of synthetic resin bottle is deformed so as to have a relatively stable quadrangle outer shape. In Comparative Example 2, body section 3 which had a substantially hexagonal shape in the initial state, is deformed into a substantially quadrangle shape. For this reason, the shape does not become a perfect circle because the size of each recessed portion varies depending on the position due to non-uniform deformation. Therefore, four pressure reduction absorbing panels are evenly arranged in body section 3 of the synthetic resin bottle. As a result, when deformed associated with the pressure reduction absorption, the recessed portions of the respective portions are formed and substantially uniformly expanded from the pressure reduction absorbing panel as a starting point, while maintaining the substantially quadrangle shape. Therefore, the body section to which the shrink label is attached can be formed to have a shape similar to a perfect circle without causing any irregular deformation.

From the abovementioned aspect, it is preferable that the synthetic resin bottle has four pressure reduction absorbing panels 8 so that the outline of body section 3 in the cross section of the synthetic resin bottle has a shape similar to a quadrangle. Further, it is preferable that all of these four pressure reduction absorbing panels 8 have the same shape and the same size and are arranged at equal intervals. That is, it is preferable that four pressure reduction absorbing panels 8 be respectively disposed at an angular interval of 90 degrees.

Figure 6:
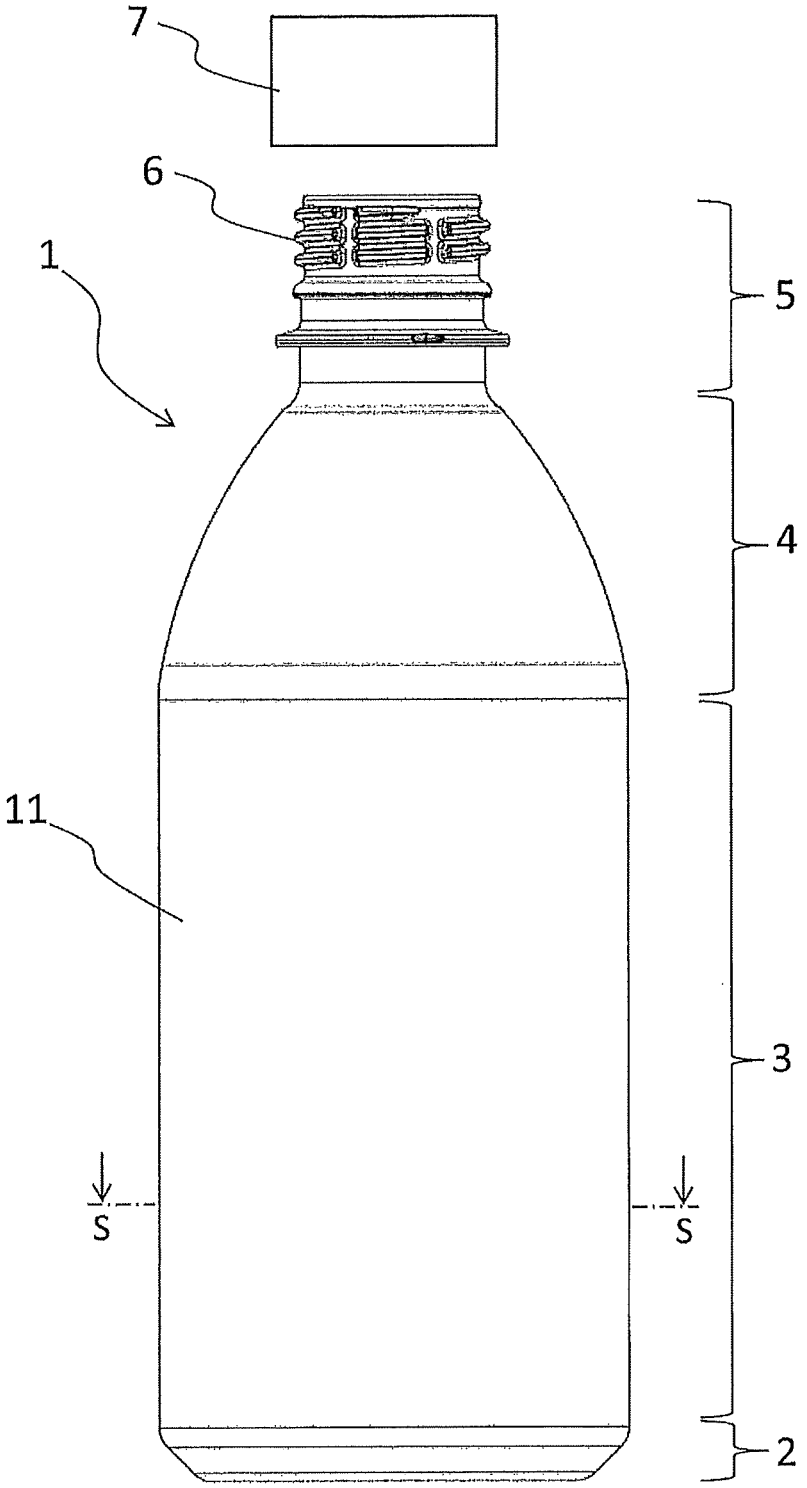
Figure 7:
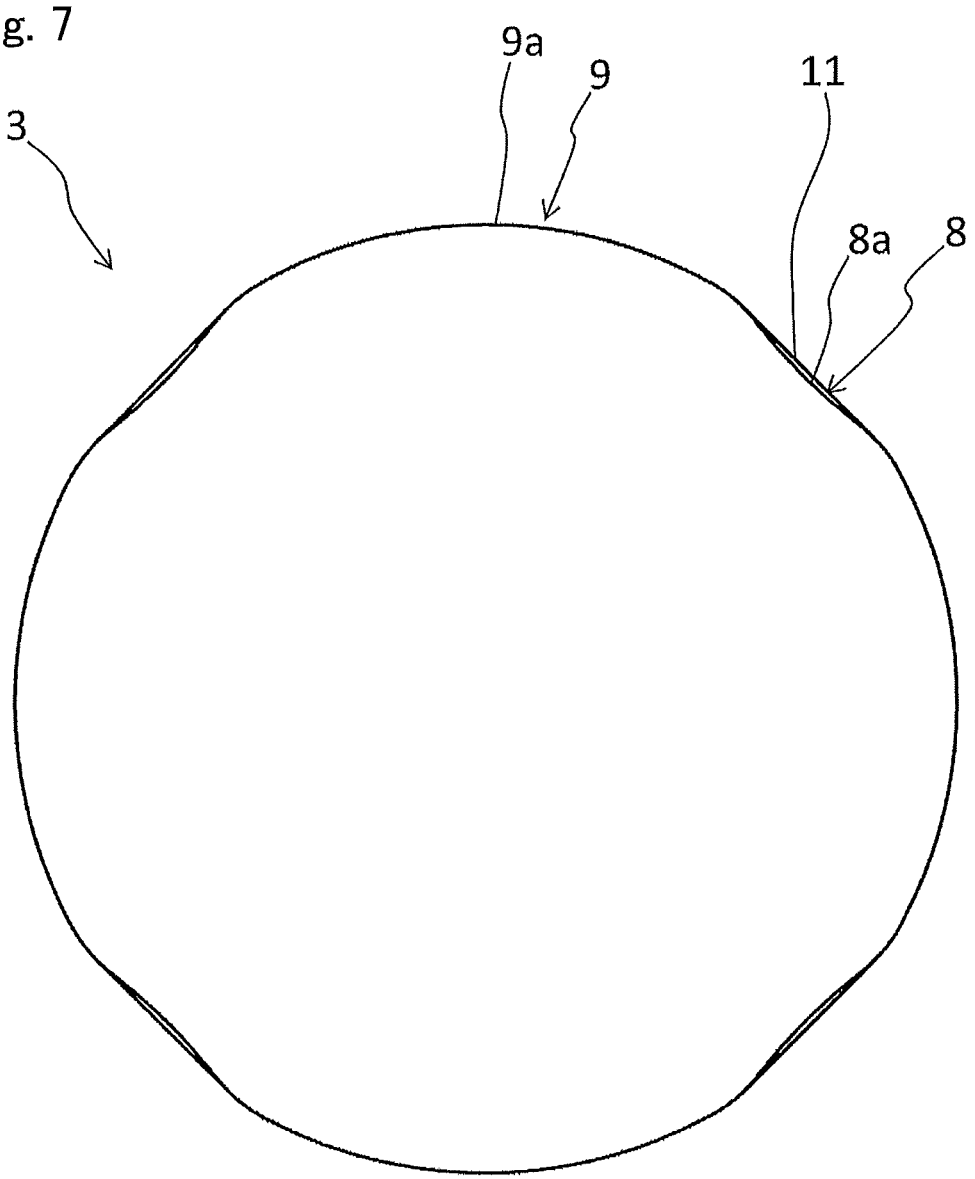
FIG. 7 Enlarged cross-sectional view schematically showing the outer shape of the cross section which is cut at the position of S-S line in FIG. 6, by a contour line FIG. 8 Enlarged cross-sectional view schematically showing a part of the outer shape before heating and after heating when a beverage is filled in the synthetic resin bottle of FIG. 1, by a contour line FIG. 9 Front view of a synthetic resin bottle of a second embodiment of the present invention

As shown in FIGS. 6 and 7, shrink label 11 made of a heat shrinkable film is attached to the outer surface of body section 3 of synthetic resin bottle 1 of the present embodiment. Specifically, as schematically shown in FIG. 7 which is an enlarged cross section view, shrink label 11 is mainly attached to arc-shaped wall surface 9*a* of column portion 9. Shrink label 11 covers recessed portion 8*a* of the pressure reduction absorbing panel 8 in a slightly floating state, without close contact with recessed portion 8*a*. As a result, the outer appearance of body section 3 exhibits a cylindrical shape similar to a perfect circle by shrink label 11. However, when edge 9*b* which is the border between the pressure reduction absorbing panel 8 and column portion 9 (see FIG. 3) has an acute angle and shrink label 11 is pressed against edge 9*b*, a line extending in the vertical direction is formed on shrink label 11 to convey an impression that synthetic resin bottle seems to be a cylinder having an appearance which exhibits a polygonal shape. For this reason, it is preferable to form the connecting portion (end portion 8*c*) between the edge 9*b* of column portion 9 and pressure reduction absorbing panel 8 into a rounded curved shape in the cross-section (see FIG. 3). By setting the curvature radius R(b) of the rounded curved shape to 5 mm or more, it is possible to prevent the abovementioned line from being formed. Shrink label 11 does not interfere with the purpose that the appearance of body section 3 exhibits a cylindrical shape similar to a perfect circle. In a preferable embodiment, curvature radius R(b) is about 10 mm.

[Heating Deformation]

Figure 8:
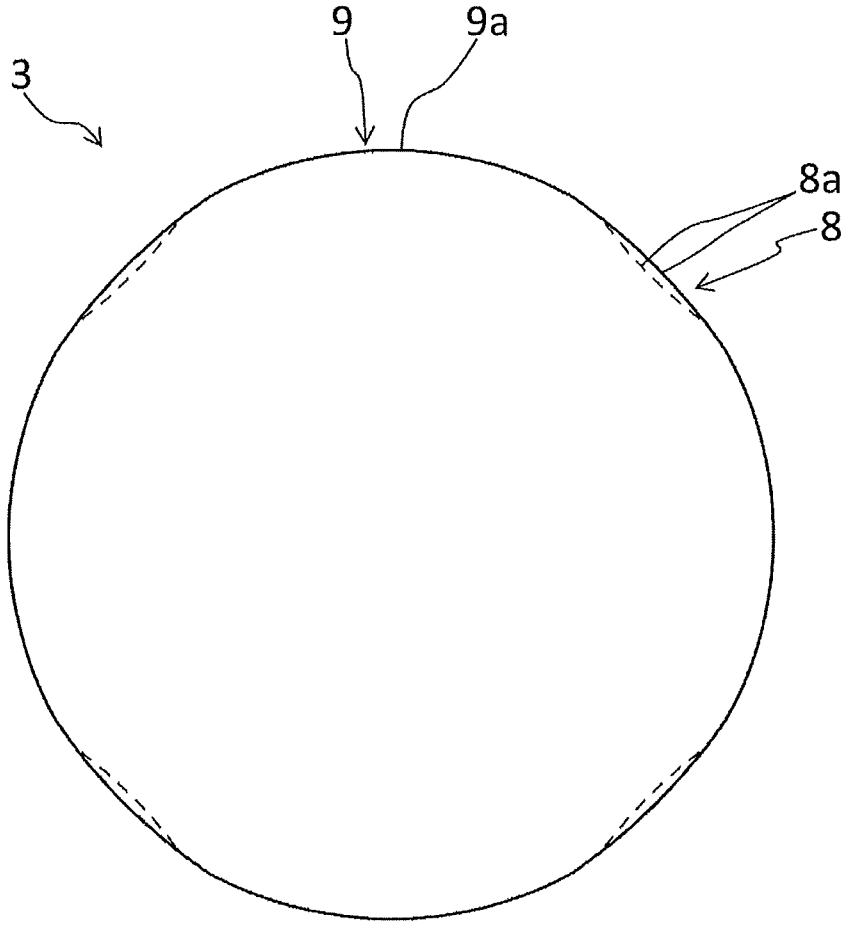

Synthetic resin bottle 1 of the present embodiment is filled with a beverage and sealed. When synthetic resin bottle 1 is heated, for example, to a temperature of about 50° C. to 60° C. and sold by a hot warmer, a hot vendor or the like, the internal pressure rises due to expansion of the internal air and the internal liquid or the like. By increasing the internal pressure, as schematically shown in FIG. 8 which is an enlarged cross-sectional view, recessed portion 8*a* of pressure reduction absorbing panel 8 is deformed to expand outwardly. The expand portion and arc-shaped wall surface 9*a* of column portion 9 are continuously connected with each other to form a substantially arc-shaped cross-sectional shape. As a result, body section 3 of synthetic resin bottle 1 can be expected to have a cylindrical shape that is closer to a perfect circle. FIG. 8 shows the shape of recessed portion 8*a* before deformation (before heating) by a broken line, also shows the shape of recessed portion 8*a* after deformation (after heating) by a solid line. In the deformation of recessed portion 8*a* of pressure reduction absorbing panel 8, when curvature radius R(a) of recessed portion 8*a* of pressure reduction absorbing panel 8 (see FIG. 3) is small, recessed portion 8*a* is barely deformed to expand outwardly even when synthetic resin bottle 1 is heated. Therefore, body section 3 of synthetic resin bottle 1 tends not to exhibit a cylindrical shape similar to a true circle. On the other hand, when curvature radius R(a) of recessed portion 8*a* is large, recessed portion 8*a* expands outwardly when synthetic resin bottle 1 is heated, and body section 3 of synthetic resin bottle 1 tends to exhibit a cylindrical shape similar to a true circle. In other words, the synthetic resin bottle of the present invention is particularly suitable for being used as a bottle to be heated.

[Another Embodiment]

Figure 9:
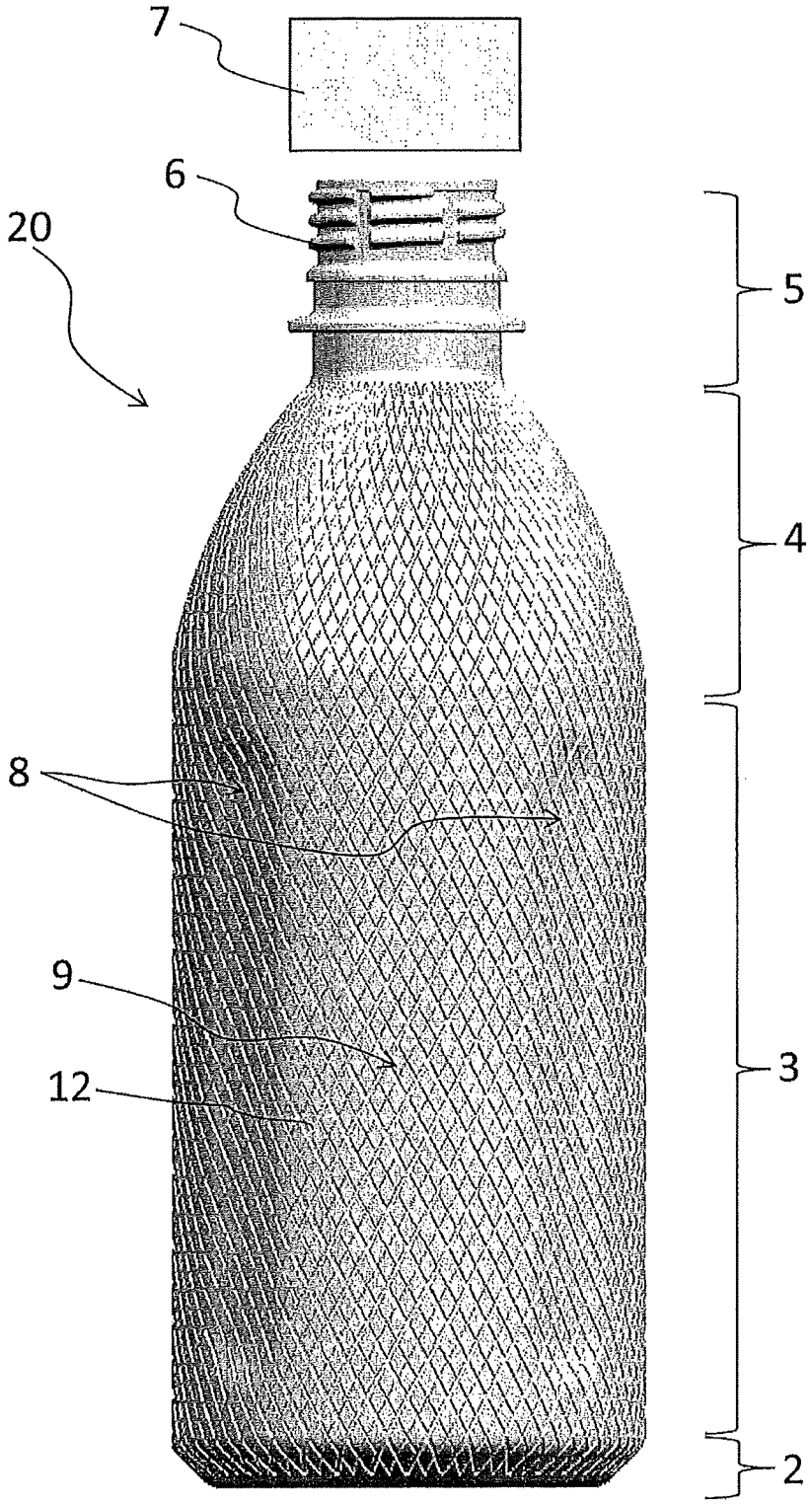

FIG. 9 shows synthetic resin bottle 20 of the second embodiment of the present invention. In synthetic resin bottle 20, a large number of fine asperities are formed on the entire outer peripheral surfaces of heel section 2, body section 3 and shoulder section 4. Such a shape having a large number of fine asperities is referred to as "embossed portion". In abovementioned synthetic resin bottle 1 of the first embodiment of the present invention, when embossed portion 12 is formed on the outer peripheral surface, it becomes possible to convey an impression that body section 3 of synthetic resin bottle 1 seems to be a cylinder having an appearance closer to a perfect circle. The reason will be described below. The embossed portion may be formed in at least body section 3.

One of the significant reasons why the shape of the body section of the synthetic resin bottle conveys an impression that the body section seems to be a cylinder having an appearance of a polygon, not a perfect circle, is that edge 9*b* at the boundary between pressure reduction absorbing panel 8 and column portion 9, or its vicinity is recognized as a line extending in the vertical direction. When the vertically extending line is recognized, it is recognized that the shape of the body section of the bottle does not have curved surface, but has flat surfaces which are joined together, and the joined portion of the flat surfaces is shown as the vertical extending line. As a result, the shape of the body section of the synthetic resin bottle is recognized as a polygonal cylinder rather than a true circular cylinder. Therefore, if the vertical extending line is inconspicuous, it is easy to convey the impression that the shape of the body section is a true circular cylinder. That is, as shown in FIG. 9, when embossed portion 12 is provided on the outer peripheral surface of body section 3 of synthetic resin bottle 20, even if a vertically extending line is generated at or near edge 9*b*, a large number of fine asperities of embossed portion 12 are conspicuous, so that the line becomes inconspicuous. As a result, since the line is hard to recognize, the shape of the body section conveys the impression that it is a true circular cylinder. In the synthetic resin bottle of the present embodiment, the impression that the shape of body section 3 of synthetic resin bottle 20 is a cylinder similar to a perfect circle can be effectively conveyed by intentionally utilizing optic illusion. In particular, in addition to setting curvature radius R(b) shown in FIG. 3 to 5 mm or more as described above, when embossed portion 12 shown in FIG. 9 is formed, the shape of body section 3 is more effective in conveying the impression that it is a true circular cylinder. From this viewpoint, it is thought that embossed portion 12 may be provided only on at least edge 9*b* and the vicinity thereof. However, in order to avoid the impression of a significant difference between the appearance of embossed portion 12 and the appearance of other portions, it is preferable to form embossed portion 12 on the entire surface of the outer peripheral surface of body section 3. In addition, when synthetic resin bottle 20 is filled with a beverage, sealed, warmed and sold, this embossed portion 12 also has the effect of making it difficult for a consumer to feel heat (making it difficult to transfer heat) when a synthetic resin bottle 20 is held by the consumer.

Embossed portion 12 is formed by forming a plurality of thin groove-like concave portions crossing each other, thereby forming about 1 to 8 convex portions (4.5 convex portions in the embodiment shown in FIG. 9) per 1 $cm^2$. Therefore, the depth of the concave portion is about 0.1 mm to 0.5 mm (0.3 mm in the embodiment shown in FIG. 9).

Also in synthetic resin bottle 20 of the present embodiment, total circumferential length A of all column portions in the cross section of body section 3 is 55% to 75% of entire circumferential length B of a true circle. The rest of the structure is the same as that of the first embodiment described above, and therefore, description thereof is omitted.

[Modification]

The synthetic resin bottle of the embodiments described above has pressure reduction absorbing panel 8 which extends in the vertical direction. It is also possible to form pressure reduction absorbing panel 8 which is inclined with respect to the vertical direction. In that case, column portion 9 is also inclined with respect to the vertical direction. The inclined angle with respect to the vertical direction is preferably 30 degrees or less.

EXPLANATION OF REFERENCE NUMBERS

1 synthetic resin bottle
2 heel section
3 body section
4 shoulder section
5 neck section
6 external thread portion
7 screw cap
8 pressure reduction absorbing panel
8*a* recessed portion
8*b* circumferential center of pressure reduction absorbing panel
8*c* end portion
9 column portion
9*a* arc-shaped wall surface
9*b* edge
9*c* circumferential center of column portion
10 virtual true circle
11 shrink label
12 embossed portion

The invention claimed is:

1. A synthetic resin bottle for aseptic filling, comprising a cylindrical body section, wherein the synthetic resin bottle has four pressure reduction absorbing panels configured to absorb pressure reduction after the bottle for aseptic filling is filled with a liquid at normal temperature and the bottle is sealed, which are arranged at equal intervals in the body section, and column portions each having an arc-shaped wall surface arranged between the pressure reduction absorbing panels, the arc-shaped wall surface of the column portion in a cross section of the body section constitutes a part of a virtual single true circle, total circumferential length of the arc-shaped wall surfaces of the column portions is 55% to 75% of entire circumferential length of the true circle at a position where the width in the circumferential direction of the pressure reduction absorbing panel is maximum, the body section has a cylindrical shape which corresponds to a perfect circle when the label is attached to the body section, and wherein the synthetic resin bottle is an aseptic bottle which has a maximum amount of pressure reduction absorption of 10 ml or less for an internal capacity of 400 ml, and the synthetic resin bottle is structured to be used for aseptic filling only.

2. A synthetic resin bottle for aseptic filling, comprising a cylindrical body section, wherein the synthetic resin bottle has four pressure reduction absorbing panels configured to absorb pressure reduction after the bottle for aseptic filling is filled with a liquid at normal temperature and the bottle is sealed, which are arranged at equal intervals in the body section, and column portions each having an arc-shaped wall surface arranged between the pressure reduction absorbing panels, the arc-shaped wall surface of the column portion in a cross section of the body section constitutes a part of a virtual single true circle, an angle formed between a radial line passing through a circumferential center of the column portion and a radial line passing through a circumferential edge of the column portion is 55% to 75% of an angle formed between a radial line passing through a circumferential center of the column portion and a radial line passing through a circumferential center of a pressure reduction absorbing panel adjacent to the column portion at a position where the width in the circumferential direction of the pressure reduction absorbing panel is maximum, the body section has a cylindrical shape which corresponds to a perfect circle when the label is attached to the body section, wherein the synthetic resin bottle is an aseptic bottle which has a maximum amount of pressure reduction absorption of 10 ml or less for an internal capacity of 400 ml, and the synthetic resin bottle is structured to be used for aseptic filling only.

3. The synthetic resin bottle according to claim 1, wherein the four pressure reduction absorbing panels have the same shape as each other.

4. The synthetic resin bottle according to claim 1, wherein an end portion of the pressure reduction absorbing panel connected to the circumferential edge of the column portion in the cross section of the body section is a curved line having a curvature radius of 5 mm or more.

5. The synthetic resin bottle according to claim 1, wherein the pressure reduction absorbing panel has a concave portion including a curved line having a curvature radius of 15 mm or more in the cross section of the body section.

6. The synthetic resin bottle according to claim 1, wherein the synthetic resin bottle is a bottle to be heated.

7. The synthetic resin bottle according to claim 1, wherein at least an outer peripheral surface of the body section is provided with an embossed portion.

8. The synthetic resin bottle according to claim 2, wherein an end portion of the pressure reduction absorbing panel connected to the circumferential edge of the column portion in the cross section of the body section is a curved line having a curvature radius of 5 mm or more.

9. The synthetic resin bottle according to claim 2, wherein the pressure reduction absorbing panel has a concave portion including a curved line having a curvature radius of 15 mm or more in the cross section of the body section.

10. The synthetic resin bottle according to claim 2, wherein the synthetic resin bottle is a bottle to be heated.

11. The synthetic resin bottle according to claim 2, wherein at least an outer peripheral surface of the body section is provided with an embossed portion.

* * * * *